United States Patent [19]

Holmboe

[11] 4,054,258

[45] Oct. 18, 1977

[54] BREAKBACK FORM TIE

[76] Inventor: James A. Holmboe, 850 Kalmia, Boulder, Colo. 80302

[21] Appl. No.: 666,856

[22] Filed: Mar. 15, 1976

[51] Int. Cl.[2] ..... E04G 17/08

[52] U.S. Cl. ..... 249/214; 249/41; 249/217

[58] Field of Search ..... 249/40–46, 249/190–191, 213–214, 216–217

[56] References Cited

U.S. PATENT DOCUMENTS

| | | | |
|---|---|---|---|
| 2,370,174 | 2/1945 | Kinninger | 249/214 |
| 2,501,412 | 3/1950 | Schaefer | 249/213 |
| 3,430,913 | 3/1969 | Johnson | 249/217 |
| 3,430,914 | 3/1969 | Clasen et al. | 249/217 |
| 3,490,730 | 1/1970 | Gates, Jr. | 249/43 |
| 3,741,516 | 6/1973 | Rugger | 249/216 |
| 3,801,061 | 4/1974 | Holt | 249/217 |

*Primary Examiner*—Francis S. Husar
*Assistant Examiner*—John McQuade
*Attorney, Agent, or Firm*—O'Rourke & Harris

[57] ABSTRACT

A breakback form tie for constructing wallforms to contour concrete in which the form tie has at the end portions thereof engaging means for interfacing with brackets, an enlarged cross section positioned inwardly of the engaging means, plug means preferably in the configuration of truncated conical members positioned between the engaging means and the enlarged cross section with the enlarged, base portion of the conical members oriented outwad from the center of the tie, and a frangible section to facilitate breakback positioned inwardly of the enlarged cross section in order that the end portions of the tie may be severed at the frangible section and the severed section of the tie and plug means concurrently removed from a concrete wall formed around the tie.

8 Claims, 8 Drawing Figures

BREAKBACK FORM TIE

BACKGROUND OF THE INVENTION

1. Field of the Invention

The present invention relates generally to form ties for concrete wallforms, and more particularly to form ties having plastic conical members or similar means thereon with provision for breakdown of the form tie and concurrent removal of the severed portion of the tie and conical member.

2. Description of the Prior Art

Wallform construction methods are well known in the construction trade. The instant invention is concerned with the wallform construction in which form ties are positioned through holes in spaced forms, i.e., plywood sheets. Engaging means are provided at each end of the tie and these are secured by brackets, such as wedgelock brackets, on the outer surface of each plywood sheet. Internally, the conical members are provided to interface between the internal surface of the concrete form and the tie. Thus, when tension is applied at each end of the tie, by, for instance, wedgelocks and walers positioned in the wedgelocks, the tie member is pretensioned with the concial member engaging the form to transfer forces between the form and the tie. Vertical strongbacks are then clamped to, for instance, the wedgelocks to provide form rigidity, and concrete may then be poured between the wallforms.

After setting, the plywood sheets are stripped from the concrete leaving the end portions of the ties protruding from either side of the concrete wall.

Heretofore, the end portions of the ties were broken back into the concrete and removed leaving the conical members in the concrete wall. Thereafter, the conical members were removed by grasping and extracting from the wall.

SUMMARY OF THE INVENTION

The present invention, which provides a heretofore unavailable improvement over previous form ties, comprises a form tie having plug means such as conical members thereon in which the breakdown section of the tie and the conical member may be concurrently removed. This is accomplished by providing an enlarged cross section in the tie, which may optionally be the primary tension force interface between the tie and conical member, and a frangible section at or inwardly of the enlarged cross section. The enlarged cross section and frangible section of the ties are preferably positioned within the conical members.

Accordingly, an object of the present invention is to provide a new and improved form tie in which the breakback section of the form tie and conical member may be concurrently removed from a formed concrete wall.

Another object of the present invention is to provide a new and improved form tie which is sturdy and reliable in operation and uncomplicated and economical to manufacture.

Yet another object of the present invention is to provide a new and improved form tie having conical members thereon which may be utilized with otherwise conventional wallform hardware.

These and other objects of the present invention will become apparent from the following description.

DETAILED DESCRIPTION OF THE INVENTION

Figure 1:
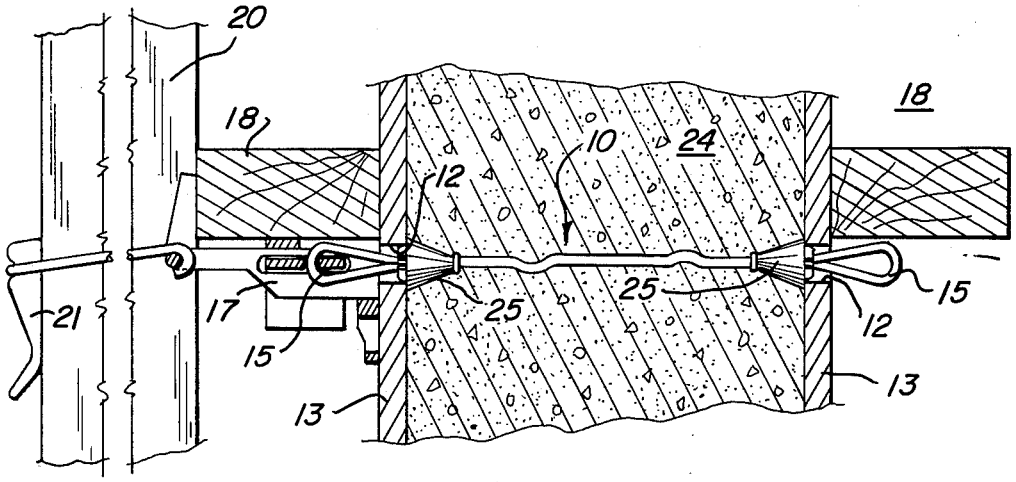
FIG. 1 is a cross sectional view of a formed and poured concrete wall in which conventional form hardware is shown on one side of the form.

Turning now to the drawings, wherein like components are designated by like reference numerals throughout the various figures, a tie of the nature with which the instant invention is concerned is illustrated in a formed wall environment in FIG. 1, and is generally designated by the reference numeral 10. As will be described in more detail below, the end of tie 10 extend through holes 12 defined in forms 13. Engaging means 15 are provided at each end of tie 10 and are, as illustrated in FIG. 1, adapted to be engaged by conventional wedgelock brackets 17. Wedgelock brackets 17 are will known in the art and engage or secure engaging means 15 with a tapered surface to tension rod or tie 10. Walers 18 are fitted into wedgelock brackets 17 to secure form 13. To provide further rigidity, strongbacks 20 are typically attached by means of strongback clamps 21 which engage wedgelock bracket 17. While the hardware is illustrated on only one side of form 13, it is of course to be understood that similar hardware is employed on both sides.

The specifically described hardware is conventional and, without deviating from the specific scope of the invention as will be described in more detail below, may be varied substantially without departing from the scope of the art. For instance, as will be specifically illustrated below, engaging means 15 may be of various configurations. Similarly, wedgelock brackets 17 may be functionally replaced with a great number of proprietary brackets. Other systems for tensioning rod or tie 10 do not necessarily employ walers 18 and strongbacks 20.

Figure 2:
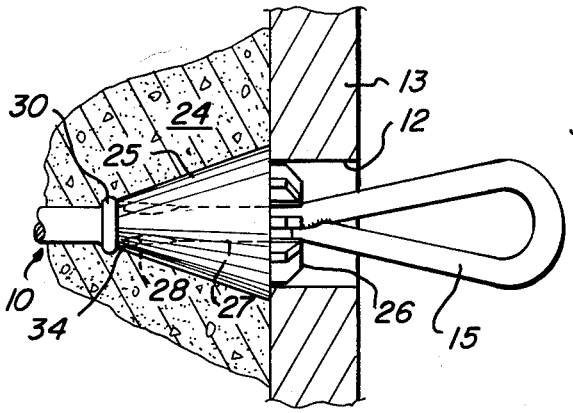
FIG. 2 is an enlarged partially cross sectional top view of a preferred embodiment of a formed tie according to the instant invention.
Figure 3:
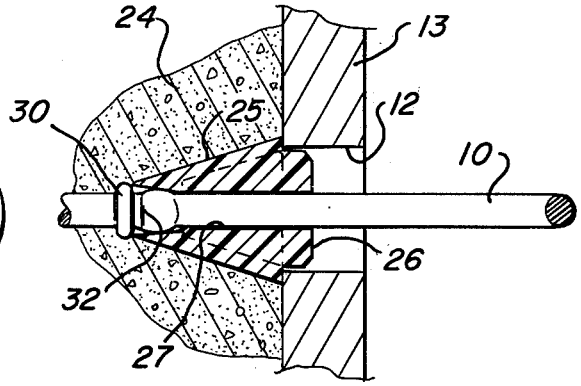
FIG. 3 is a fully cross sectioned side view of the form tie of FIG. 2.
Figure 4:
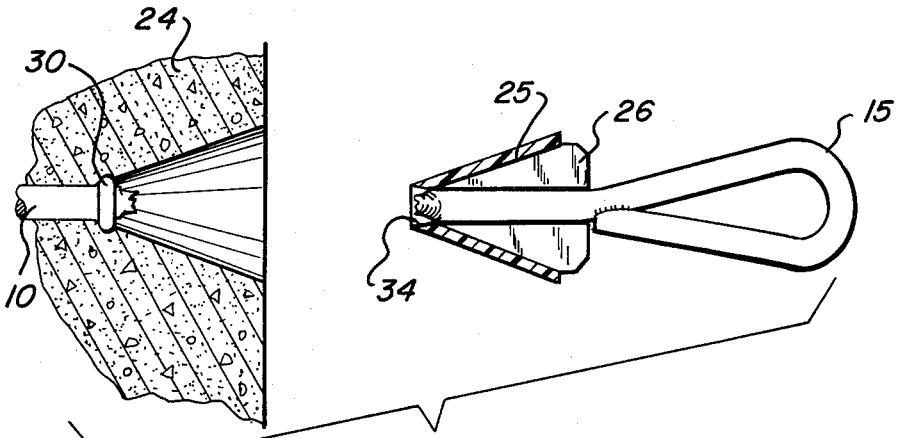
FIG. 4 is a partial cross sectioned view of the form tie of FIG. 2 after the breakback operation is completed.

The specific advantageous nature of tie 10 in accordance with the instant invention will be more readily appreciated with reference to FIGS. 2 through 4. As shown, plug means 25 is provided to engage hole 12 defined in form 13. Radial projections 26 center plug means 25 in hole 12. Thus, when tension is applied to tie 10 through engaging means 15, plug means 25 engages form 13 and transfers the forces from tie 10 to a substantial area of form 13 around hole 12.

Plug means 25 may be of any number of shapes, but is preferably shaped as a truncated conical member having a concentric longitudinal channel 27 through which tie 10 is disposed and secured. A frangible section 28 is provided in tie 10 and is preferably positioned within plug means 25 as shown in FIG. 2. Shoulder 30 is, as illustrated, provided on tie 10 to bear against plug means 25.

In the embodiment shown in FIGS. 2 and 3, the tooling operation which provides frangible section 28, as shown in FIG. 2, concurrently provides an enlarged cross section 32 as shown in FIG. 3. Again, only with regard to the illustrated preferred embodiment, shoulder 30 engages plug means 25 and transfers tension forces from tie 10 to plug means 25. Frangible section 38 and enlarged cross section 32 are preferably positioned within flared portions 34 of channel 27 through plug means 25.

The novel aspects of tie 10 are essentially passive in the modes illustrated in FIGS. 2 and 3. However, as illustrated in FIG. 4, after concrete 24 has set and forms 13 are removed, the end portion of tie 10 may be readily severed at frangible section 28 by, for instance, imparting a torsional force at engagement means 15. When severed at frangible portion 28, enlarged cross section 32 engages the narrowed portion of channel 27 in plug means 25, i.e., adjacent flared portion 34, and, accordingly, serves to remove plug means 25 from said concrete 24 as the severed portion of tie 10 is removed. Thus, in one operation, both the severed portion of tie 10 and plug means 25 are removed from said set concrete 24. Conventionally, the severed portion of tie 10 would be independently removed thus leaving plug means 25 remaining in said concrete 24. Since concrete walls may well have thousands of ties 10 each with two ends, substantial cost savings are realized by combining both operations.

Figure 5:
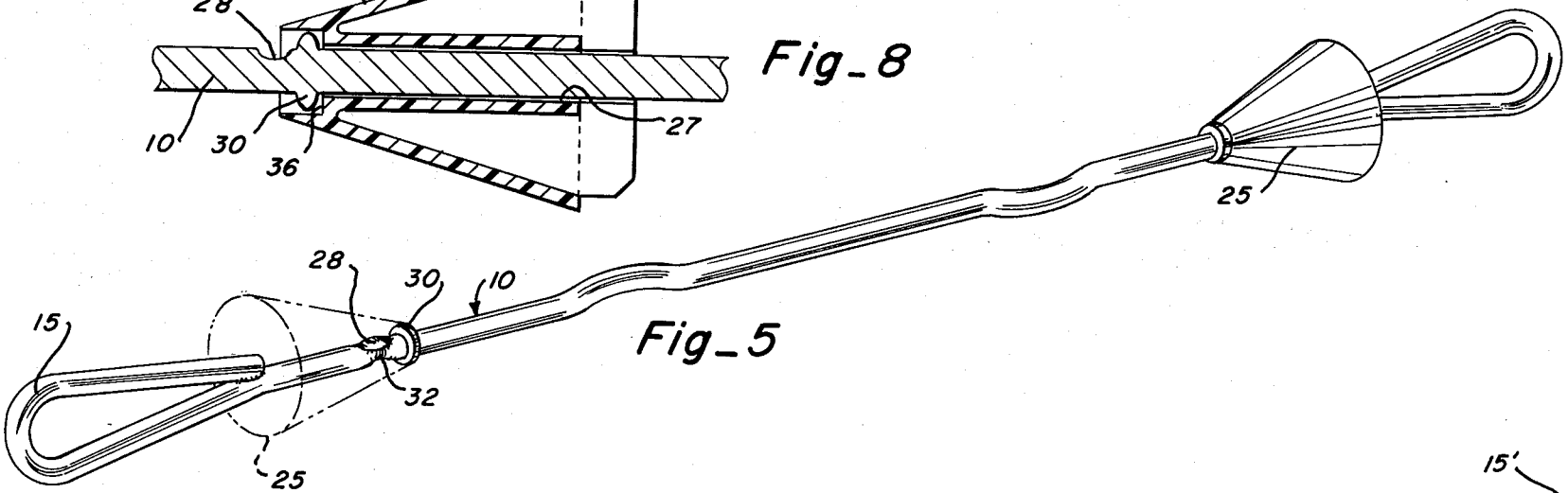
FIG. 5 is a perspective view of a form tie according to the instant invention.
Figure 6:
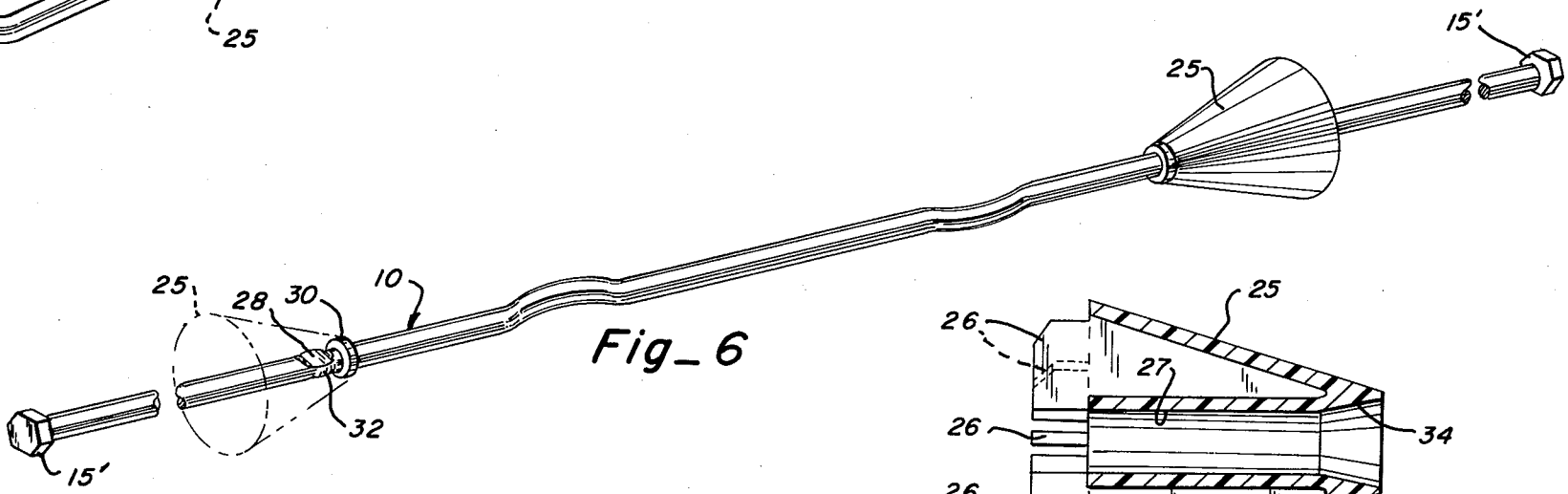
FIG. 6 is a perspective view of a form tie similar to that of FIG. 5 but having alternative end engaging means.

The details of the invention will be more readily understood with regard to FIGS. 5 and 6 in which the above-discussed embodiment of plug means 25 is illustrated as described above with regard to engaging means 15, in FIG. 5, and also with regard to another typical engaging means 15', shown in FIG. 6. Essentially, ties 10 shown in FIGS. 5 and 6 are functionally identical, but the embodiment shown in FIG. 6 employs engaging means 15' adapted for use with form hardware somewhat different than that described above. However, such hardware is conventional and not a part of this invention.

Figure 7:
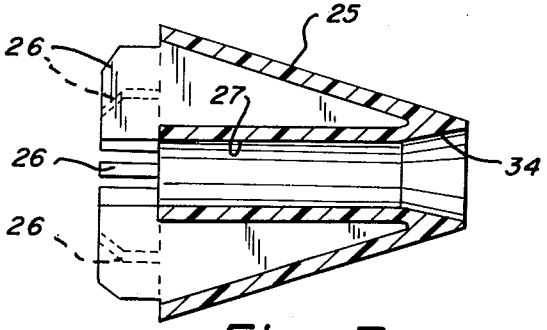
FIG. 7 is a cross sectional view of a conical member according to the instant invention.

A preferred embodiment suitable for employment with the above-described embodiment is illustrated in FIG. 7. Plug means 25 includes radial projections 26 which, as described with particular respect to FIGS. 2 and 3, serve to pilot plug means 25 into proper alignment with hole 12 and form 13. A longitudinal channel 27 is defined through plug means 25 and preferably includes at the end thereof opposite that on which radial projections 26 are disposed a flared portion 34. As shown in FIGS. 5 and 6, frangible section 28 and enlarged cross section 32 are preferably positioned within flared portion 34 of plug means 25. This substantially isolates frangible section 28 and enlarged cross section 32 from the concrete wall and thus facilitates severing of the end portion of tie 10 as described above.

Figure 8:
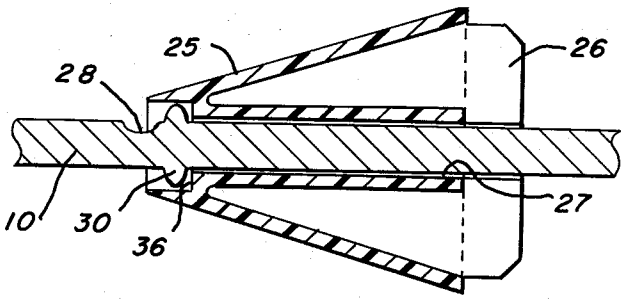
FIG. 8 is an enlarged cross sectional view of an alternative embodiment of the instant invention.

Though the embodiment of tie 10 and plug member 25 illustrated in FIGS. 1 through 7 is fully satisfactory, a number of other arrangements are also useful. For instance, as shown in FIG. 8, tie 10 may be configured somewhat differently with frangible section 28 disposed inwardly of shoulder 30. Also, plug means 25 would, instead of flared portion 34 shown in FIG. 7, be shaped with internal step 36. Otherwise, plug member 25, as illustrated in FIG. 8, is substantially identical to that illustrated in FIG. 7.

In operation, the embodiment of FIG. 8 is quite similar to that described above, but after severing tie 10 at frangible section 28, shoulder 30 would serve to displace plug means 25 with the severed portion of tie 10. Prior to severing, shoulder 30 serves, as above-described, to transfer forces from tie 10 to plug means 25 and specifically against internal step 36. While the need for a separate enlarged cross section 32, as in the embodiment of FIGS. 1 through 7, is avoided by the embodiment of FIG. 8, this is not a critical advantage in that, in the embodiment of FIGS. 1 through 7, the same tooling operation which forms frangible section 28 also forms enlarged cross section 32. Rather, FIG. 8 merely illustrates the various arrangements in which the instant invention is operable.

Although only two embodiments of the present invention have been illustrated and described, it is anticipated that various changes and modifications will be apparent to those skilled in the art, and that such changes may be made without departing from the scope of the invention as defined by the following claims.

I claim:

1. A tie rod for concrete forming structure, the tie rod comprising:

an elongated member having at least one engaging means at an end thereof;

a frangible section defined in the elongated member at a position spaced inward along the elongated member from the engaging means;

an enlarged cross section portion formed on the elongated member within the length thereof defined at one end by the frangible section and defined at the other end by the engaging means; and an annular shoulder formed on the elongated member adjacent the frangible section and on the opposite side thereof than the enlarged cross section portion;

plug means having a channel defined therethrough positioned with the elongated member extending through the channel, the channel being at least in part of a restricted cross sectional area insufficient to permit the enlarged cross section portion of the elongated member to pass therethrough and having a larger diameter end portion of greater cross section than the enlarged cross section portion but of a smaller cross section than the shoulder with the larger diameter end -portion of the channel facing the shoulder and being of a length greater than the distance between the shoulder and the enlarged cross section portion of the elongated member;

whereby, the shoulder may seal against the plug means to isolate the frangible section from poured concrete and, after being cast in concrete, a portion of the elongated member may be severed at the frangible section and the severed portion of the elongated member and plug means concurrently removed from the concrete by means of the enlarged cross section portion of the severed portion of the elongated member bearing directly upon the restricted cross sectional area of the channel through the plug means.

2. A tie rod as set forth in claim 1 in which the frangible section and the enlarged cross section portion are at immediately adjacent positions along the elongated member.

3. A tie rod as set forth in claim 2 in which the frangible section is comprised of a pinched, narrow section in the elongated member and the enlarged cross section portion is formed of the material displaced by the formation of the pinched section in the elongated member.

4. A tie rod as set forth in claim 1 in which the engaging means at the end of the elongated member is in the form of a substantially closed loop member.

5. A tie rod as set forth in claim 1 in which the engaging means at the end of the elongated member is in the form of a bolt head hexagonal member.

6. A tie rod as set forth in claim 1 in which the plug means is a truncated conical member with the channel formed concentrically therethrough, the larger diameter end portion of the channel defined at the smaller end of the conical member and being in the form of a flared enlargement in the channel, the conical member being positioned on the elongated member with the larger end of the conical member disposed towards the engaging means, and the enlarged cross sectional portion of the elongated member positioned within the flared enlargement in the channel with the shoulder bearing against the smaller end of the conical member.

7. A tie rod as set forth in claim 1 in which a second frangible section, a second enlarged cross section portion, a second annular shoulder and a second plug means are disposed in the same relative position with regard to a second engaging means at the other end of the elongated member as the corresponding members are disposed relative to the first engaging means.

8. A tie rod forming structure, the tie rod comprising:

an elongated member having a first and second engaging means at opposite ends thereof;

first and second frangible sections defined in the elongated member at positions spaced inwardly along the elongated member from the first and second engaging means, respectively;

first and second annular shoulders formed on the elongated member at positions spaced inwardly of the first and second frangible sections, respectively;

a pair of plug means each having a channel defined therethrough positioned with the elongated member extending through the channel, the channels each having an end portion of greater diameter than the remainder of the channel but of a smaller diameter than the annular shoulders, each plug means further being positioned between one of the annular shoulders formed on the elongated member and the corresponding adjacent engaging means with the greater diameter end portion of the channel disposed toward the annular shoulder; and first and second interference means adapted to bear directly upon the corresponding plug means to limit movement of the elongated member through the more restricted portion of the channel provided on the elongated member between the first engaging means and the first frangible section and the second engaging means and the second frangible section, respectively, the distance between each annular shoulder and the corresponding interference means being less than the length of the greater diameter end portion of the channel and the cross section of the interference means being less than that of the greater diameter end portion of the channel;

whereby, after being cast in concrete, a portion of the elongated member may be severed at the frangible section and the severed portion of the elongated member and the corresponding plug means concurrently removed from the concrete by means of the interference means bearing directly upon the plug means thereby precluding movement of the severed portion of the elongated member independent of plug means, and prior to pouring the concrete, the annular shoulders may engage the end portion of the corresponding plug means to seal the frangible section and interference means within the associated greater diameter end portion of the channel.

* * * * *

UNITED STATES PATENT OFFICE

CERTIFICATE OF CORRECTION

PATENT NO. : 4,054,258
DATED : October 28, 1977
INVENTOR(S) : James A. Holmboe

It is certified that error appears in the above-identified patent and that said Letters Patent are hereby corrected as shown below:

Column 1, line 9 "breakdown" should be "breakback"
Column 1, line 44, "breakdown" should be "breakback"
Column 3, line 12, "Frangible section 38" should be "Frangible section 28"
Column 5, line 4, "by the formation" should be "by formation"
Column 5, line 34, "A tie rod forming structure" should be "A tie rod for concrete forming structure"
Column 5, line 35, "having a first" should be "having first"

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*